US005203397A

United States Patent [19]

Bandyopadhyay

[11] Patent Number: 5,203,397

[45] Date of Patent: Apr. 20, 1993

[54] HEATING ASSEMBLY FOR A DIE-CASTING MACHINE

[75] Inventor: Srekumar Bandyopadhyay, Battle Creek, Mich.

[73] Assignee: Hotset Corporation, Battle Creek, Mich.

[21] Appl. No.: 862,491

[22] Filed: Apr. 2, 1992

[51] Int. Cl.[5] ..... B22D 17/02

[52] U.S. Cl. ..... 164/309; 164/312; 164/337

[58] Field of Search ..... 164/337, 309, 310, 311, 164/316, 317, 318, 48, 250.1, 312, 492, 493, 513

[56] References Cited

U.S. PATENT DOCUMENTS 4,231,416 11/1980 Nikolov et al. ..... 164/316
4,638,849 1/1987 Whitehorn ..... 164/311
4,717,052 1/1988 Urbanic et al. ..... 164/337

FOREIGN PATENT DOCUMENTS 0136554 10/1980 Japan ..... 164/309
0084864 4/1987 Japan ..... 164/316
0137162 6/1987 Japan ..... 164/316

*Primary Examiner*—Richard K. Seidel
*Assistant Examiner*—Erik R. Puknys
*Attorney, Agent, or Firm*—Herbert Dubno

[57] ABSTRACT

A nozzle body of stainless steel surrounded by a single layer of turns of a strip electrical heater interconnects a die caster and a sprue of a cluster of casting cavities in a die casting apparatus. The heating element is surrounded by a protective tube and the ends of the gap between the protective tube and the nozzle body are closed by annular members.

9 Claims, 1 Drawing Sheet

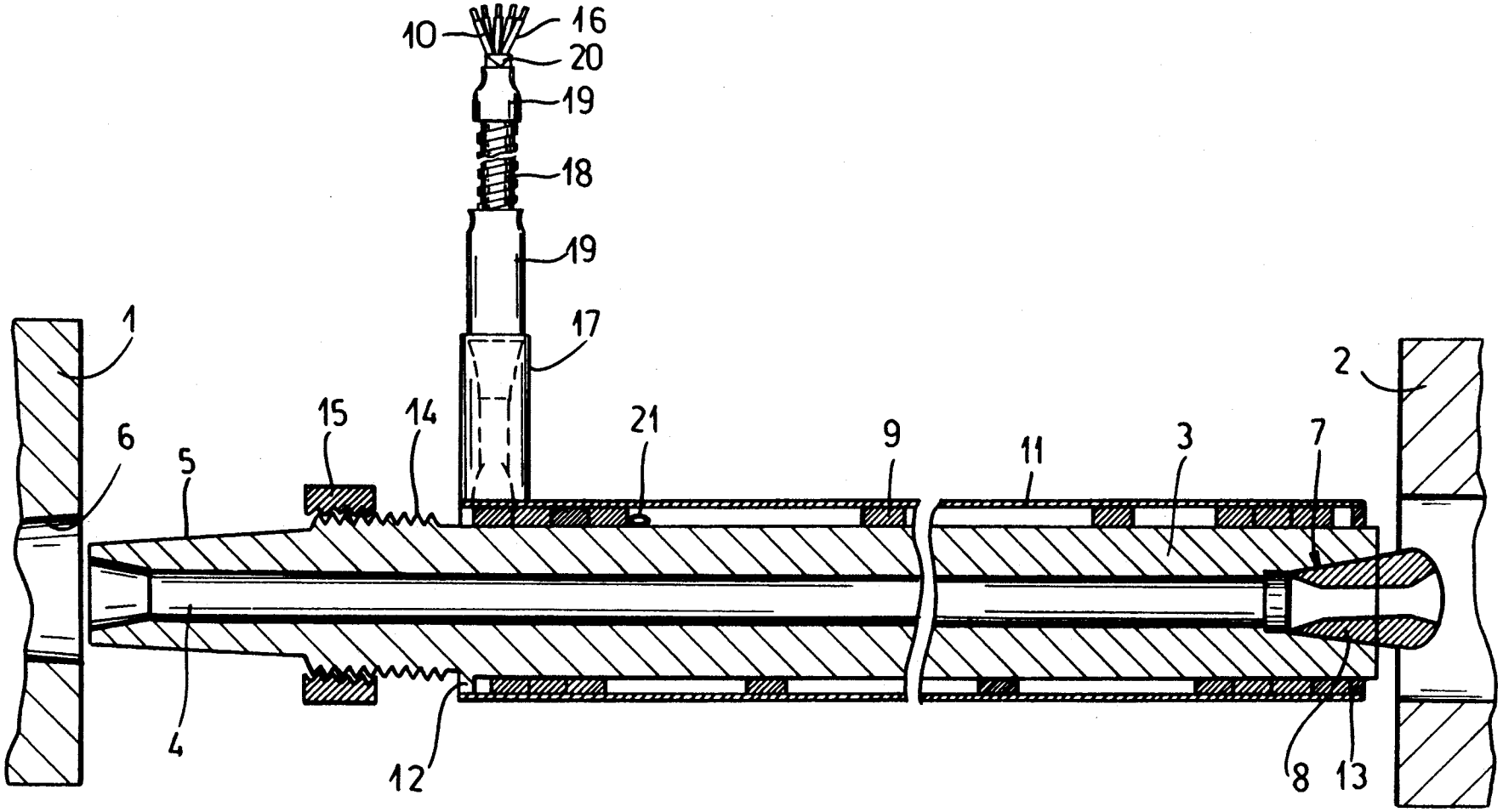
2
7
3
11
9
21
16
20
19
18
19
17
10
14
15
5
1
6
13
8
12
4

HEATING ASSEMBLY FOR A DIE-CASTING MACHINE

FIELD OF THE INVENTION

My present invention relates to a heating assembly for a die-casting machine and, more particularly, to an apparatus for heating the material stream between the die caster and the die cavities or sprue of a die-casting die, especially for the die casting of zinc and magnesium.

BACKGROUND OF THE INVENTION

Generally the die-casting apparatus will comprise a casting die provided with a cluster of cavities in which individual articles of zinc or magnesium are to be cast, a sprue or feeder passage for delivering the molten metal to the cavity cluster, and a die-casting machine which delivers the molten metal under pressure to the die. Along the path of the molten metal, a tubular nozzle body is provided for conveying the molten metal (zinc or magnesium) to the cluster of cavities.

To avoid cooling of the flow of material in this nozzle body below the minimum permissible temperature for die casting, it has been proposed to heat the nozzle body.

For this purpose, within the nozzle body tubular heating cartridges can be inserted. The heating cartridges extend generally parallel to the flow passage through the nozzle body.

This apparatus has been found to be relatively expensive since the nozzle body must be assembled from a plurality of parts to allow the tubular heating element to be inserted into the nozzle body and the nozzle body must be reassembled after replacement. The joints between the parts frequently pose problems, the construction of the nozzle body often requires substantially transverse dimensions thereof, and the disassembly of the assembly is time-consuming and labor-consuming as far as maintenance is concerned.

The large transverse dimensions of the nozzle body are a reason why the nozzle body cannot be brought close to the cluster of die cavities in the casting die but must be spaced relatively far from its cluster. As a consequence, the amount of material filling the extended sprue which is required to cover this distance may be considerable. The result is that the casting process involves the formation of large quantities of lost material which may have to be remelted later but, for any particular casting operation, is not available.

OBJECTS OF THE INVENTION

It is, therefore, the principal object of the present invention to provide a die-casting assembly in which a heated nozzle body is provided between the die caster and the casting mold cluster, whereby the aforementioned drawbacks are avoided.

Another object of this invention is to provide an assembly of the latter type which has a simpler construction by comparison with the prior art system, which is less expensive to fabricate than has heretofore been the case, and which enables, because of reduced dimensions, the nozzle body to be brought closer to the cluster of mold cavities in the casting die than has hitherto been the case.

It is also an object of this invention to provide a low-cost nozzle body and heating assembly which is more compact and more readily maintained than earlier devices of this type.

SUMMARY OF THE INVENTION

These objects and others which will become apparent hereinafter are attained, in accordance with this invention, in an assembly of a casting die having a cluster of cavities and a sprue extending to these cavities in the die, a die caster supplying the molten zinc or molten magnesium, and a nozzle body connecting the sprue with the die caster.

According to this invention, the nozzle body is a tube of stainless steel having a throughgoing passage for the molten casting metal. At the machine side end of this nozzle body, it is formed with an external conical connector which is engageable by a wedging action in an internal cone formed in the die caster. At its opposite end, i.e. at its die end receivable in the die, the tubular body is provided with an internal conical seat for receiving a mouthpiece. Surrounding the stainless steel body is a resistance heating element which is electrically powered and has a band shape and which is wrapped in a plurality of turns helically around the nozzle body.

The electrical connectors of this resistance heater are carried out of the assembly transversely to the nozzle body and a thin-wall protective tube of stainless steel is fitted over the single-layer of turns of the heater and can retain the latter tightly against the body of the nozzle so that the protective tube can be shoved axially over the heating body turn and the single layer of these turns is fixed between the protective tube and the outer wall of the nozzle body.

The opposite axial ends of the gap between the outer wall of the nozzle body and the protective tube are closed by annular elements which are bonded to the nozzle body and to the inner wall of the protective tube.

The term "bonded" in this sense means connected with a continuity of material as if the ring is unitary with the part to which it is connected, i.e. in one piece therewith, or is joined to that part by welding so that there is a certain interdiffusion of material.

Thus the annular part can be formed either in one piece with the outer wall of the nozzle body or with the inner wall of the protective tube or can be welded to either. The ring can be welded to both or formed as part of the one and welded to the other.

With the construction of the invention, a heated nozzle body is formed which need only be slightly larger than the nozzle body itself because of the arrangement of the heating element as wrapped around the nozzle body in a single layer.

The band-shaped heating body has a rectangular cross section, e.g. a square cross section, so that the turns can be brought close together where desired and tightly against the nozzle body.

Since the heating body can be hermetically sealed between the outer wall of the nozzle body and the inner wall of the protective tube and between the axially-spaced ring at the opposite end, the heating element is fully protected against metal spray from the die casting operation and also ensures good heat transfer and an effective heat distribution to the passage traversed by the molten metal.

The compact construction and the good heat distribution to the flow passage ensures a long useful life of both the nozzle body and of the heating element.

Because of this construction, moreover, it is possible to extend the nozzle body surrounded by the heating element significantly more deeply into the die or to a location closer to the cluster of cavities than has hitherto been the case. The length of the sprue which is therefore required, can be held relatively small, thereby sharply reducing the losses of the cast metal.

Advantageously, the nozzle body is formed externally with a screw thread onto which a positioning nut is threaded proximal to its outer cone so that, for example, by driving the nut, the nozzle body can be eased out of the internal cone forming the seat in the die-casting machine.

The advantage of this system is that, with the nut backed away, the outer cone can be seated with a wedge-like tightness in the internal cone of the die caster. However, by tightening of the nut, the nozzle body is easily released when pressed out of the conical seat of the die caster.

Advantageously a region adjacent this externally threaded zone is formed with an outwardly extending annular collar unitary with the nozzle body and which is welded to the protective tube to form one of the annular gap closure members which have been described.

With this construction, it is possible to use the collar as an abutment for the first turn of the heating element to wrap around the nozzle body. The collar also forms a shoulder or abutment bracing the heating element as the protective tube is shoved axially over the heating element until it meets the collar where it is welded.

The other annular element can then be inserted into the gap from the opposite axial end and welded in place to the protective tube and the nozzle body.

The annular parts, namely, the latter ring and the collar, may be composed of the same material as the protective tube and the nozzle body, namely, from stainless steel. An advantage of this construction is that at opposite ends of the gap, the number of turns of the heating element per unit length can be greater than in an intermediate region of the gap. In other words, close to the ends of the protective tube, the single layer heating element strip can be wound more tightly than in any intervening region between these end regions where the pitch of the helical turns and the axial spacing of successive turns is greater. This arrangement has been found to provide excellent heat distribution. However, other turn arrangements can be provided if other distributions are desirable.

Advantageously the wall thickness of the nozzle body in the region protected by the tube is about ten times the wall thickness of the protective tube. In this region enclosed by the protective tube, moreover, a thermocouple can be provided, for example, an NiCr-Ni or an Fe-CuNi thermocouple, whose conductors pass with the conductors of the heating element radially outwardly through a sleeve which can also be composed of stainless steel and can be sealingly connected to the protective tube. At the end of this stainless steel sleeve, a flexible armored metal tube can be sealed, from a free end of which, remote from the nozzle body, the conductors can emerge. It has also been found to be advantageous to enclose the conductors in a tube of glass fabric or braid, e.g. of fiberglass.

BRIEF DESCRIPTION OF THE DRAWINGS

The above and other objects, features and advantages of the present invention will become more readily apparent from the following description, reference being made to the accompanying drawing, the sole FIGURE of which is an axial section through an assembly according to the invention.

SPECIFIC DESCRIPTION

The apparatus of the invention comprises a die caster 1 capable of supplying zinc or magnesium molten metal under pressure, a die 2 provided with a cluster of cavities and a sprue, both of which have been shown highly schematically, and a tubular nozzle body 3 of stainless steel having a passage 5 for the liquid casting metal which can interconnect these two schematically shown parts with the apparatus.

The nozzle body 3 at its end turned toward the die caster 1, is formed with an outer conical connector 5 which can wedge in a complementary internally conical cavity 6 of the pressure caster 1. At its opposite end, received in the die 2, the nozzle body 3 has an internal conical recess 7 into which a mouthpiece 8 is complementarily fitted.

Along the outer surface of the nozzle body 3, a heating element 9 in the form of a strip is wound. This resistive heating element has conductors 10 for completing the electric circuit and extending transversely of the nozzle body 3.

Over the single layer of helical turns of the heating element 9, a thin-walled protective tube 11 of stainless steel is axially sealed and extends coaxially with the nozzle body 3 to snugly surround and hug the heating element 9.

The turns of the heating element 9 are fixed between the protective tube 11 and the outer surface of the nozzle body 3. The gap between the nozzle body and the protective tube 11 is closed at its end by ring-shaped parts 12 and 13.

The ring-shaped part 13 is a ring which is welded to the inner wall of the protective tube 11 and to the outer wall of the nozzle body 3. The annular part 12 is a radially projecting collar unitary with the nozzle body 3 and welded to the inner wall of the protective tube 11.

The nozzle body 3 has between the cone 5 and the collar 12, an externally threaded zone 14 upon which a positioning nut 15 is screwed. By rotation of the nut 15 against the machine 1 when the outer cone 5 engages in the recess 6 and is wedged therein, the nut 15 can drive the nozzle body 3 out of the die caster to allow separation of the two.

As can be seen from the drawing as well, at the ends of the protective tube 11, the turns of the heating element 9 are more closely positioned than in the intervening region in which the turns have a greater pitch and axial spacing from one another.

The wall thickness of the nozzle body 3 in the region surrounded by the protective tube 11 is about ten times the wall thickness of the protective tube.

In the region enclosed by the protective tube 11, a thermocouple 21 can be provided adjacent the heating element 9. The conductors 16 or the thermocouple 21 are led together when the conductors 10 of the heating element 9 form the assembly.

The conductors can be led out through a tubular fitting or sleeve 17 of stainless steel which is welded to the protective tube 11. A flexible armored metal sheath 18 can be connected to the tubular fitting 17 by a swaged sleeve 19 sealingly.

Another swaged sleeve 19 is provided at the opposite end of the sheath 18 from which the conductors 10 and 16 emerge. The conductors can be provided with terminals or the like to connect them in the usual circuit.

The conductors can be surrounded by a sleeve of fiberglass, a portion of which has been shown at 20 in the drawing.

In practice it has been found to be advantageous to make the total length of the device between the collar 1 and the end lodged in the die 2 about 195 mm. The outer diameter including the protective tube 11 can be, for example, 55 mm. The outer diameter of the nozzle body 3 can be, for example, 42 mm and the diameter of the throughgoing bore 4 can be 10 mm. The power requirements of the electrical heating element can be, for example, 1500 watts. The thermoelement can be an NiCr-Ni thermocouple. The invention is not limited to the embodiment illustrated and described but includes such modifications as lie within the spirit and scope of the appended claims and embraces all devices of the invention taken individually and in any combination.

I claim:

1. A die-casting apparatus, comprising:

a die caster for producing a material stream of a molten metal selected from the group which consists of zinc and magnesium, said die caster having an internally conical seat;

a tubular nozzle body formed with a passage for conducting said material stream, an externally conical end receivable in and adapted to be wedged into said seat, and an internally conical recess at an opposite axial end of said body;

a die having a sprue and formed with a mouthpiece engaging in said recess and receiving said stream;

an electrical heating element in a form of a strip wrapped around an outer surface of said nozzle body in a multiplicity of turns in a single layer;

a thin-wall protective tube slid axially over said layer and defining an axially extending gap with said tubular nozzle body, said turns being secured between said protective tube and said nozzle body; and respective annular members closing opposite axial ends of said gap and bonded to both an inner wall of said tube and said nozzle body, said strip having a greater number of turns per unit length at each end of said protective tube than between said ends of said protective tube.

2. A die-casting apparatus, comprising: a die caster for producing a material stream of a molten metal selected from the group which consists of zinc and magnesium, said die caster having an internally conical seat;

a tubular nozzle body formed with a passage for conducting said material stream, an externally conical and receivable in and adapted to be wedged into said seat, and an internally conical recess at an opposite axial end of said body;

a die having a sprue and formed with a mouthpiece engaging in said recess and receiving said stream;

an electrical heating element in a form of a strip wrapped around an outer surface of said nozzle body in a multiplicity of turns in a single layer;

a thin-wall protective tube slid axially over said layer and defining an axially extending gap with said tubular nozzle body, said turns being secured between said protective tube and said nozzle body; and respective annular members closing opposite axial ends of said gap and bonded to both an inner wall of said tube and said nozzle body, said nozzle body having a wall thickness which is substantially ten times the wall thickness of said protective tube in a region of said nozzle body surrounded by said protective tube.

3. A die-casting apparatus, comprising: a die caster for producing a material stream of a molten metal selected from the group which consists of zinc and magnesium, said die caster having an internally conical seat;

a tubular nozzle body formed with a passage for conducting said material stream, an externally conical end receivable in and adapted to be wedged into said seat, and an internally conical recess at an opposite axial end of said body;

a die having a sprue and formed with a mouthpiece engaging in said recess and receiving said stream;

an electrical heating element in a form of a strip wrapped around an outer surface of said nozzle body in a multiplicity of turns in a single layer;

a thin-wall protective tube slid axially over said layer and defining an axially extending gap with said tubular nozzle body, said turns being secured between said protective tube and said nozzle body;

respective annular members closing opposite axial ends of said gap and bonded to both an inner wall of said tube and said nozzle body; and a thermocouple in a region enclosed by said protective tube.

4. The apparatus defined in claim 3 wherein said thermocouple is an NiCr-Ni or Fe-CuNi thermocouple.

5. The apparatus defined in claim 3 wherein said heating element and said thermocouple have conductors extending in common from said protective tube.

6. The apparatus defined in claim 5 wherein said conductors extend through a metal sleeve welded to said protective tube and an armored sheath secured to said sleeve.

7. The apparatus defined in claim 6 wherein said conductors are surrounded by a fiberglass sleeve.

8. The apparatus defined in claim 6, further comprising an external threaded zone on said nozzle body proximal to said externally-conical end and a nut on said zone.

9. The apparatus defined in claim 8, further comprising an annular collar formed on said nozzle body adjacent said zone and constituting a respective one of said annular members, said collar being welded to said protective tube.

* * * * *